United States Patent [19]

Boehm, Jr.

[11] Patent Number: 4,932,472

[45] Date of Patent: Jun. 12, 1990

[54] PACKOFF WITH FLEXIBLE SECTION FOR CASING HANGER

[75] Inventor: Carl F. Boehm, Jr., Houston, Tex.

[73] Assignee: Vetco Gray Inc., Houston, Tex.

[21] Appl. No.: 343,959

[22] Filed: Apr. 26, 1989

[51] Int. Cl.[5] ..... E21B 33/04

[52] U.S. Cl. ..... 166/208; 166/182; 166/217; 277/117; 277/236; 285/348

[58] Field of Search ..... 166/115, 208, 217, 134, 166/182; 277/117, 118, 191, 206 R, 236; 285/146, 140, 348, 382.5, 382.7, 351, 917

[56] References Cited

U.S. PATENT DOCUMENTS

| | | | |
|---|---|---|---|
| 4,131,287 | 12/1978 | Gunderson et al. | 277/191 |
| 4,178,020 | 12/1979 | Dopyera | 285/18 |
| 4,353,560 | 10/1982 | Tohill | 277/236 |
| 4,595,053 | 6/1986 | Watkins et al. | 166/209 |
| 4,665,979 | 5/1987 | Boehm, Jr. | 166/208 |
| 4,742,874 | 5/1988 | Gullion | 166/348 |
| 4,751,965 | 6/1988 | Cassity | 166/182 |
| 4,766,956 | 8/1988 | Smith et al. | 166/182 |
| 4,787,642 | 11/1988 | Etheridge | 277/236 X |
| 4,790,572 | 12/1988 | Slyker | 166/182 X |

*Primary Examiner*—Hoang C. Dang
*Attorney, Agent, or Firm*—James E. Bradley

[57] ABSTRACT

A metal seal or packoff for a casing hanger has features which allow a slight downward movement of the casing hanger relative to the well head after the seal has been set. The seal ring has a base and inner and outer walls that extend upward from the base. The inner and outer walls are radially separated by an annular cavity. An energizing ring will move into this cavity to push the inner and outer walls farther apart into sealing engagement with the casing hanger and wellhead. A protective member locates below the base. A flexible section extends downward from the protective member, while joining the protective member to the base. The flexible section is located on the inner side of the base and has a radial dimension that is much less than the base. This thin section enables the base to flex if downward movement of the casing hanger occurs after the seal has been set. The flexing reduces the chance for any movement between the inner and outer walls and the wellhead and casing hanger to take place.

3 Claims, 2 Drawing Sheets

47
41
39
33c
43
45
21
17
37
33b
35
31
23
54
29
33
27
33a
56
15
11
25
61
53
51
49
57
55
59
19
13

PACKOFF WITH FLEXIBLE SECTION FOR CASING HANGER

BACKGROUND OF THE INVENTION

1. Field of the Invention

This invention relates in general to packoffs for casing hangers, and in particular to a metal packoff which will accommodate some movement between the casing hanger and the wellhead.

2. Description of the Prior Art

One type of oil and gas well assembly utilizes a wellhead at the surface which may be on the seafloor. A casing hanger secures to the upper end of a string of casing that extends into the well. The casing hanger lands in the wellhead to support the weight of the casing. An annular space exists between the exterior of the casing hanger and the bore of the wellhead. A packoff or seal locates in this annular space to seal against pressure from the annular space surrounding the casing below the casing hanger.

One type of prior art packoff is a metal seal. It is not subject to deterioration as much as elastomeric seals. One type of metal seal is generally U-shaped, with inner and outer walls separated by an annular cavity. An energizing ring is forced into this cavity to deform the inner and outer walls radially. This causes the inner and outer walls to seal tightly against the exterior of the casing hanger and the wellhead bore. Wickers, which are small circumferential parallel grooves, may be located in the wellhead bore and on the casing hanger exterior. The inner and outer walls embed into these wickers to provide the seal and to provide a gripping force for the seal member.

While this is workable, normally a casing hanger may move downward slightly relative to the wellhead after the packoff has been set. This occurs due to test pressure being applied to the casing hanger after the packoff is set. If such movement occurs, there is a possibility that the seal of the packoff may be lost due to this relative movement.

SUMMARY OF THE INVENTION

In this invention, the seal ring is of a type having inner and outer walls which are separated by an annular cavity. Each wall has a seal section that sealingly engages the casing hanger or the wellhead. An energizing ring deforms the inner and outer walls radially apart to cause the sealing.

A protective member locates below the base of the seal member for providing protection during running. A flexible section joins the protective member to the base. The flexible section locates on the inner side of the base and is of considerably less radial thickness than the base.

The thickness of the flexible section, as well as the vertical thickness of the base, are selected so that they will allow flexing to occur in this area. This flexing allows the inner wall to move downward slightly relative to the outer wall. This preserves the seals of the inner and outer walls even though a slight movement of the casing hanger relative to the wellhead occurs.

DETAILED DESCRIPTION OF THE INVENTION

Figure 1:
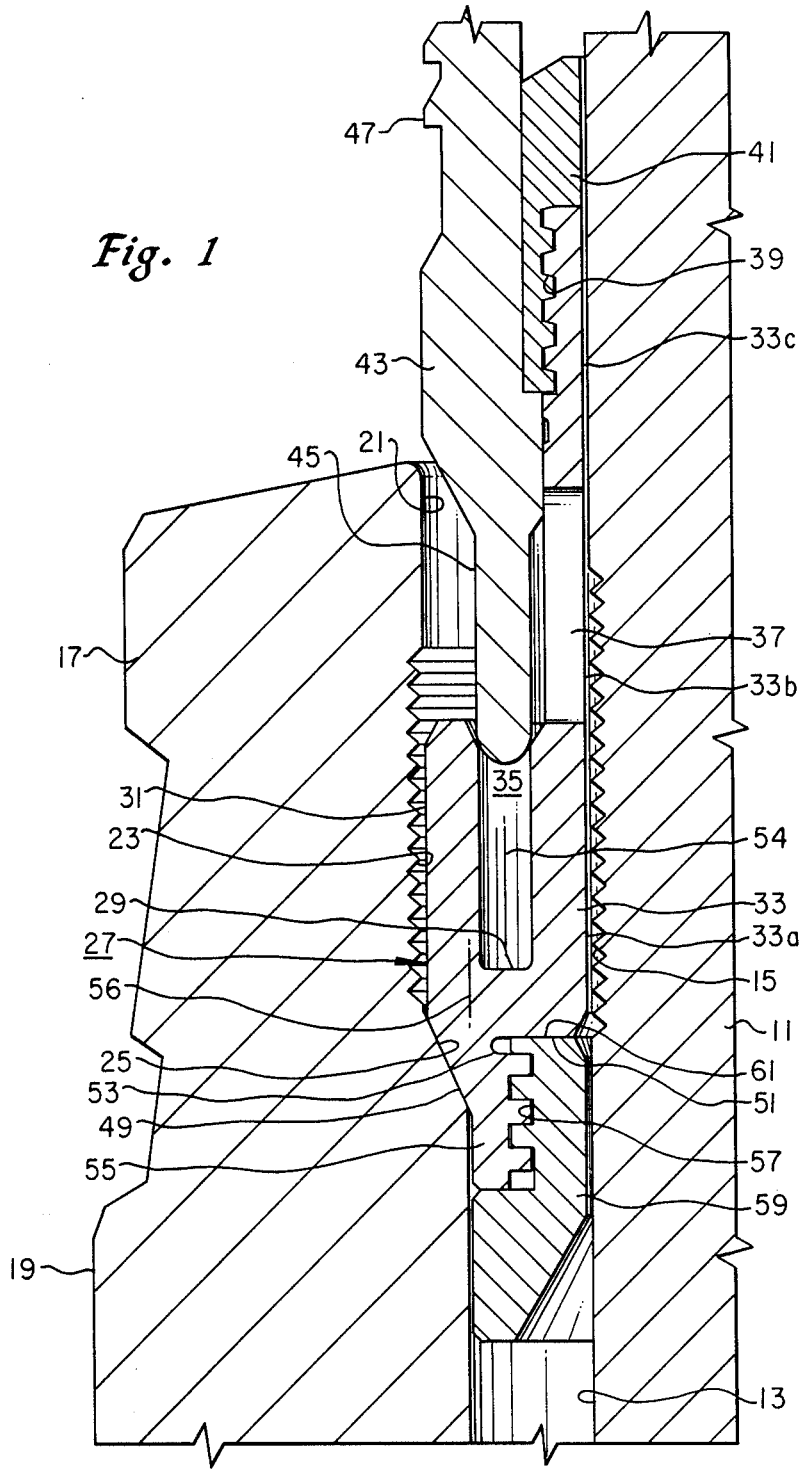
FIG. 1 is a partial sectional view illustrating a packoff constructed in accordance with this invention, and in the condition that exists prior to being energized.

Referring to FIG. 1, a wellhead 11 is partially shown. Wellhead 11 is a large tubular member located at the surface of the well, which may be on the sea floor. Wellhead 11 has a bore 13 that is cylindrical and which contains a set of wickers 15. Wickers 15 are small circumferential grooves formed in the bore 13. Preferably, each of the grooves of the wickers is triangular in cross-section, forming about a 70 degree angle at the apex between upper and lower flanks.

A casing hanger 17 locates within the wellhead 11. Casing hanger 17 secures to the upper end of a string of casing (not shown) which extends into the well. Casing hanger 17 lands on a landing shoulder (not shown) in the bore 13 of the wellhead 11. After landing, cement will be pumped down the casing and up the annular space surrounding the casing. Casing hanger 17 has a bore 19. The exterior 21 of the casing hanger 17 is spaced inward from the bore 13 of wellhead 11. This results in an annular clearance between the exterior 21 and the bore 13. A set of wickers 23 are formed on the exterior 21 of casing hanger 17. Wickers 23 are identical to the wickers 15, but do not have as much axial length. Wickers 23 will be located directly across from the wickers 15 when the casing hanger 17 has landed. The exterior 21 of casing hanger 17 also includes a frustoconical shoulder 25. Shoulder 25 faces upward and outward and is at an inclination of about 25 degrees relative to the longitudinal axis of casing hanger 17.

A packoff or seal ring 27 locates in the annular clearance between the wellhead 11 and casing hanger 17. Seal ring 27 has a base 29. Seal ring 27 is of metal, preferably mild steel having a hardness of about 120 to 140 Brinnell. An inner wall 31 and an outer wall 33 extend upward from the base 29. The outer wall 33 extends upward a considerable distance more than the inner wall 31. The outer wall 33 has a seal section **33*a* on the lower end which seals against the wellhead wickers 15. A slotted section 33*b* extends above the seal section 33*a*. A retaining section 33*c* extends upward from the slotted section 33*b*. An annular cavity 35 separates the inner wall 31 from the outer wall 33. A plurality of vertical slots 37 extend through the slotted section 33*b*. Slots 37 reduce the hoop strength of the outer wall 33 to facilitate the outward deformation of the seal section 33*a* into the wickers 15**.

A set of internal threads 39 are located on the retaining section 33. Threads 39 secure a retainer 41. Retainer 41 serves as an upper stop for an axially movable energizing ring 43. Energizing ring 43 has a lower wedging section 45. The wedging section 45 initially locates above the cavity 35 as the seal ring 27 is placed between the casing hanger 17 and wellhead 11. During setting, a running tool forces the energizing ring 43 downward, causing the wedging section 45 to wedge the inner and outer walls 31, 33 radially apart. The wedging section 45 has passages (not shown) to allow fluid located in the cavity 35 to pass as the wedging section 45 moves into the cavity 35. The energizing ring 43 has a threaded section 47 which a retrieving tool will grip if it is desired to pull the energizing ring 43 back to the upper position.

A frusto-conical shoulder 49 is located on a lower inner portion of the seal ring 27. Shoulder 49 faces downward and inward. Shoulder 49 has the same inclination and mates with the shoulder 25. The upper termination of shoulder 49 is located on the inner side of the base 29. The lower termination of the shoulder 49 is located below the lower end 51 of the base 29.

A flexible section 53 integrally joins the base lower surface 51. Flexible section 53 is a necked or reduced radial thickness section. The flexible section 53 leads to a threaded section 55 which extends downward below the base lower surface 51. The inner side of the flexible section 53 will be at the shoulder 49. The outer side of the flexible section 53 is a radius which is at the junction of the threaded section 55 and the base lower surface 51. The radial thickness or dimension of the flexible section 53 is measured from the radius on the outer side to the shoulder 49 in a line perpendicular to the axis of the casing hanger 17. This radial dimension is considerably less than the radial dimension of the base 29, preferably less than half.

Also, the flexible section 53 locates radially inward from the center line 54 of the cavity 35. The outer side of the flexible section 53, which is the radius at the junction of the base bottom surface and the threaded section 55, is located radially inward of the cavity center line 54. Center line 54 is a line equidistant between the inner and outer walls 31, 33. The flexible section 53 has a center line 56 equidistant between its inner and outer sides, which is located radially inward of the center line 54.

The threaded section 55 has a plurality of external threads 57. A protective ring 59 secures to the threads 57. The protective ring 59 has an upper end 61 that will abut the lower surface 51 of the base 29. The radial dimension of the protective end 59 immediately below the threaded section 55 is only slightly less than the radial distance from the wellhead bore 13 to the casing hanger 17 below the shoulder 25.

In operation, the casing (not shown) will be lowered into the well, with the casing hanger 17 located on the upper end. The casing hanger 17 lands in the wellhead 11. The string of casing will then be cemented in place.

Then, the seal ring 27 will be lowered into the position shown in FIG. 1. In this position, the seal ring shoulder 49 will engage the casing hanger shoulder 25. The inner wall 31 will be spaced a slight distance from the casing hanger wickers 23. The outer wall 33 will be spaced a slight distance from the wellhead wickers 15. The upper end 61 of the protective ring 59 will be in contact with the lower surface 51 of the seal ring base 29.

Figure 2:
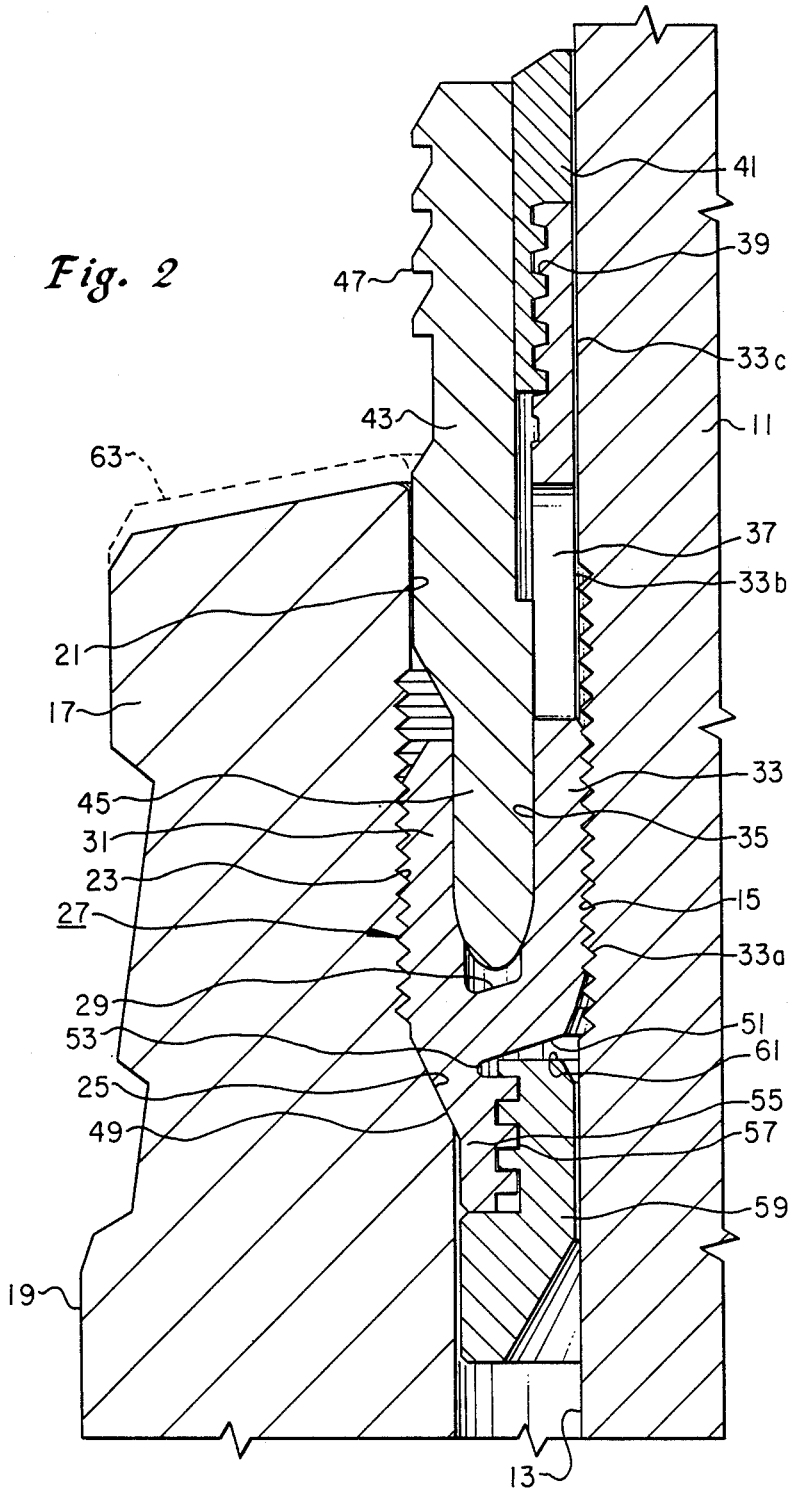
FIG. 2 is a partial sectional view of the packoff of FIG. 1, but showing the packoff in an energized condition, and with the casing hanger in a slightly lower position than exists in FIG. 1.

Then, the running tool moves the energizing ring 43 downward with great force. As shown in FIG. 2, this deforms the inner wall 31 and outer wall 33 permanently. The deformation is sufficient to cause portions of the inner wall 31 to embed within the wickers 23. The deformation forces portions of the seal section **33*a* to embed within the wickers 15. A reactive force which is upward and outward normal to the shoulder 25, enhances the deformation process of the lower portion of the outer wall seal section 33*a*. After being energized, the upper end 61 of the protective ring 59 will still be in abutting contact with the base lower surface 51**.

Then, test pressure will be applied to the casing hanger 17. The force from this test will normally be high enough to cause the casing hanger 17 to move downward slightly in the wellhead 11 due to elasticity of the components on which the casing hanger 17 lands. This is illustrated by the dotted lines 63 in FIG. 2, and for a seven inch casing hanger 17, may be as high as one-eighth inch or more. There will be no relative movement between the outer wall seal section **33*a* and the wellhead wickers 15. Furthermore, there will be no relative movement between the inner wall 31 and the casing hanger wickers 23. However, the flexible section 53 will flex slightly, as well as the base 29. The axial dimension of the base 29 from the lower surface 51 to the bottom of the cavity 35 is sufficiently small to allow this movement. The base 29 will incline slightly relative to the longitudinal axis of the wellhead 11, from the perpendicular position shown in FIG. 1. This inclination results in the base lower surface 51 separating from the protective member upper end 61. The shoulder 49 will remain in abutting contact with the shoulder 25**.

The invention has significant advantages. The flexible base and flexible section avoid the possibility of a seal being lost because of relative movement between the seal member and one of the sealing surfaces on the casing hanger and wellhead. The flexible section assures that no relative movement will take place between the inner and outer walls of the seal ring and the seal sections or wickers on the casing hanger and wellhead.

While the invention has been shown in only one of its forms, it should be apparent to those skilled in the art that it is not so limited, but is susceptible to various changes without departing from the scope of the invention.

I claim:

1. In a well having inner and outer concentric tubular members with an annular clearance between, an improved seal means for sealing in the clearance between the tubular members, comprising in combination:

a metal seal ring adapted to be located in the clearance and having a base and inner and outer walls extending upward from inner and outer sides of the base, respectively, and radially separated by an annular cavity;

the inner and outer walls each having a seal section for sealing contact with one of the tubular members;

an energizing ring movable into a lower energized position in the cavity, wedging the walls of the seal sections tightly against the inner and outer tubular members to form a seal;

a protective member located below the base and having an outer side and an inner side; and means for fixedly securing the inner side of the protective member to the base at the inner side only of the base, with the outer side of the base remaining free of any fixed attachment to the protective member, whereby downward movement of the inner concentric tubular member relative to the outer tubular member after the seal ring has been set causes the inner wall of the seal ring to move downward relative to the outer wall of the seal ring, and causes the base to incline.

2. In a well having a casing hanger located within a wellhead and having an annular clearance therebetween, an improved seal means for sealing in the clearance, comprising in combination:

a metal seal ring adapted to be located in the clearance and having a base and inner and outer walls extending upward from inner and outer sides of the base, respectively, and radially separated by an annular cavity, defining a generally U-shaped member in cross-section;

the inner and outer walls each having a seal section for sealing contact with the casing hanger and the wellhead, respectively;

an energizing ring movable into the lower energized position in the cavity, wedging the walls of the seal sections tightly against the casing hanger and wellhead to form a seal;

an annular protective member located below the base, the protective member having an upper end, an outer side and an inner side;

a flexible section integrally formed with and extending downward from the inner side of the base, the base having a downward facing lower surface extending radially from the flexible section in an outward direction, the protective member upper end facing the lower surface of the base;

means for fixedly securing the inner side of the protective member to the flexible section, the outer side of the protective member being free of fixed attachment to the base; and the flexible section and the base enabling the inner wall to move a slight distance downward relative to the outer wall in the event of slight downward movement of the casing hanger relative to the wellhead, the downward movement of the inner wall inclining the base and causing a separation of the upper end of the protective member from the lower surface of the base.

3. In a well having a casing hanger located within a wellhead and having an annular clearance therebetween, an improved seal means for sealing in the clearance, comprising in combination:

a metal seal ring adapted to be located in the clearance and having a base and inner and outer walls extending upward from the base and radially separated by an annular cavity, defining a generally U-shaped member in cross-section;

the inner and outer walls each having a seal section for sealing contact with the casing hanger and the wellhead, respectively;

an energizing ring movable into a lower energized position in the cavity, wedging the walls of the seal sections tightly against the casing hanger and wellhead to form a seal;

an annular protective member located below the base, the protective member having an upper end;

a flexible section extending downward from the base on an inner side of the base, the base having an downward facing lower surface extending radially from the flexible section in an outward direction, the protective member upper end facing the lower surface of the base;

a threaded section integrally joined to the flexible section and extending downward therefrom, the threaded section having a set of exterior threads to which the protective member is secured; and the flexible section and base enabling the inner wall to move a slight distance downward relative to the outer wall to prevent loss of the seals against the casing hanger and the wellhead in the event of slight downward movement of the casing hanger relative to the wellhead, the downward movement of the inner wall causing a separation of the upper end of the protective member from the lower surface of the base.

* * * * *